US006165015A

United States Patent [19]

Wu et al.

[11] Patent Number: 6,165,015

[45] Date of Patent: Dec. 26, 2000

[54] ELECTRICAL CONNECTOR

[75] Inventors: Kun-Tsan Wu, Tu-Chen; Song-Rong Chiou, Taipei Hsien, both of Taiwan

[73] Assignee: Hon Hai Precision Ind. Co., Ltd., Taipei Hsien, Taiwan

[21] Appl. No.: 09/116,778

[22] Filed: Jul. 16, 1998

[30] Foreign Application Priority Data

| | | | |
|---|---|---|---|
| Jul. 17, 1997 | [TW] | Taiwan | 86212164 |
| Aug. 16, 1997 | [TW] | Taiwan | 86214197 |
| Aug. 21, 1997 | [TW] | Taiwan | 86214396 |

[51] Int. Cl.[7] ..... H01R 13/648

[52] U.S. Cl. ..... 439/607; 439/567

[58] Field of Search ..... 439/607, 608, 439/609, 610, 29, 567

[56] References Cited

U.S. PATENT DOCUMENTS

| | | | |
|---|---|---|---|
| 4,183,611 | 1/1980 | Casciotti et al. . | |
| 4,685,761 | 8/1987 | Locati | 439/843 |
| 5,639,267 | 6/1997 | Loudermilk | 439/701 |

*Primary Examiner*—Khiem Nguyen

[57] ABSTRACT

An electrical connector includes an insulative housing having an L-shaped intermediate plate integrated therein which defines passageways for receiving contacts each of which has a horizontal portion retained in a horizontal portion of the corresponding passageway and a multi-bent portion horizontally limited in a vertical portion of the passageway formed by adjacent spacers. A positioning device received in the housing and having digits extending therefrom is used to vertically limit the multi-bent portions of the contacts in position when the digits of the positioning device are interspaced between the spacers. First and second shieldings are configured to enclose the housing to suppress noise and the two shieldings are coated with different materials.

16 Claims, 4 Drawing Sheets

ELECTRICAL CONNECTOR

BACKGROUND OF THE INVENTION

1. Field of the Invention

The present invention relates to an electrical connector, and particularly to an electrical connector which has two shieldings coated with different material for promoting the efficiency of the shielding effect.

2. The Prior Art

Advanced electrical connectors, particularly high frequency electrical connectors, are covered with a corresponding shielding for suppression of noise during signal transmission. The shielding is further installed with a positioning device for effectively positioning the connector onto a printed circuit board to have a stable soldering effect during a wave soldering procedure. Some related patents are U.S. Pat. Nos. D345,343, D344,492, D345,140 5,017,156 and Taiwan Patent Nos. 81,110,335 81,217,896 81,300,211 82,101,300 83,310,726 84,104,611. However, the shielding devices as disclosed in the above patents are made by stamping and bending from a single body which, for subsequent wave soldering, must be coated with nickel (Ni) and tin (Sn) on the surface thereof. However, the Sn-coated surface, due to its softness, is apt to be partially scratched or peeled off during assembly, therefore, the outer appearance thereof is affected. The other drawback is that the positioning of the above connectors on the mother board is not secure enough thus causing unstable displacement during the wave soldering procedure which adversely affects the electrical connection of the contacts with the mother board. Therefore, an improved high frequency electrical connector which can overcome the drawbacks of conventional electrical connectors is required.

SUMMARY OF THE INVENTION

The primary purpose of the present invention is to provide an improved electrical connector which can provide a relatively good shielding effect with different coating layers for preventing the shielding surface from being scratched or peeled off during assembly.

Another purpose of the present invention is to provide an improved electrical connector which can be firmly secured to a mother board, thus achieving good signal transmission therebetween.

In accordance with one aspect of the present invention, an electrical connector comprises an insulative housing having an upper wall between two side walls each defining a sidewall recess therein, an L-shaped intermediate plate integrated with the side walls having a horizontal portion defining passageways therein for interferentially receiving contacts, a vertical portion from which a plurality of spacers extend, and a receiving space defined between the upper wall, the side walls and the spacers. A first metallic shielding is adapted to enclose the housing and having an upper wall opposite a lower wall and two side walls between the upper and lower walls, each side wall having a first engaging tab and a second engaging tab, wherein the second engaging tab engages with the sidewall recess of the housing. A second metallic shielding has two side walls and a main wall between the side walls wherein each side wall defines a hole for engaging with the first engaging tab of the first shielding. Each contact comprises a horizontal portion interferentially fitting in the passageway, and a multi-bent portion connected to the horizontal portion and horizontally retained in position by the spacers of the housing. A positioning device includes a body portion and a plurality of digits extending downward from the body portion. The positioning device is adapted to be received in the receiving space of the housing, wherein the digits are interspaced between the spacers of the housing for vertically limiting the multi-bent portions of the contacts in position.

DETAILED DESCRIPTION OF THE PREFERRED EMBODIMENT

Figure 1:
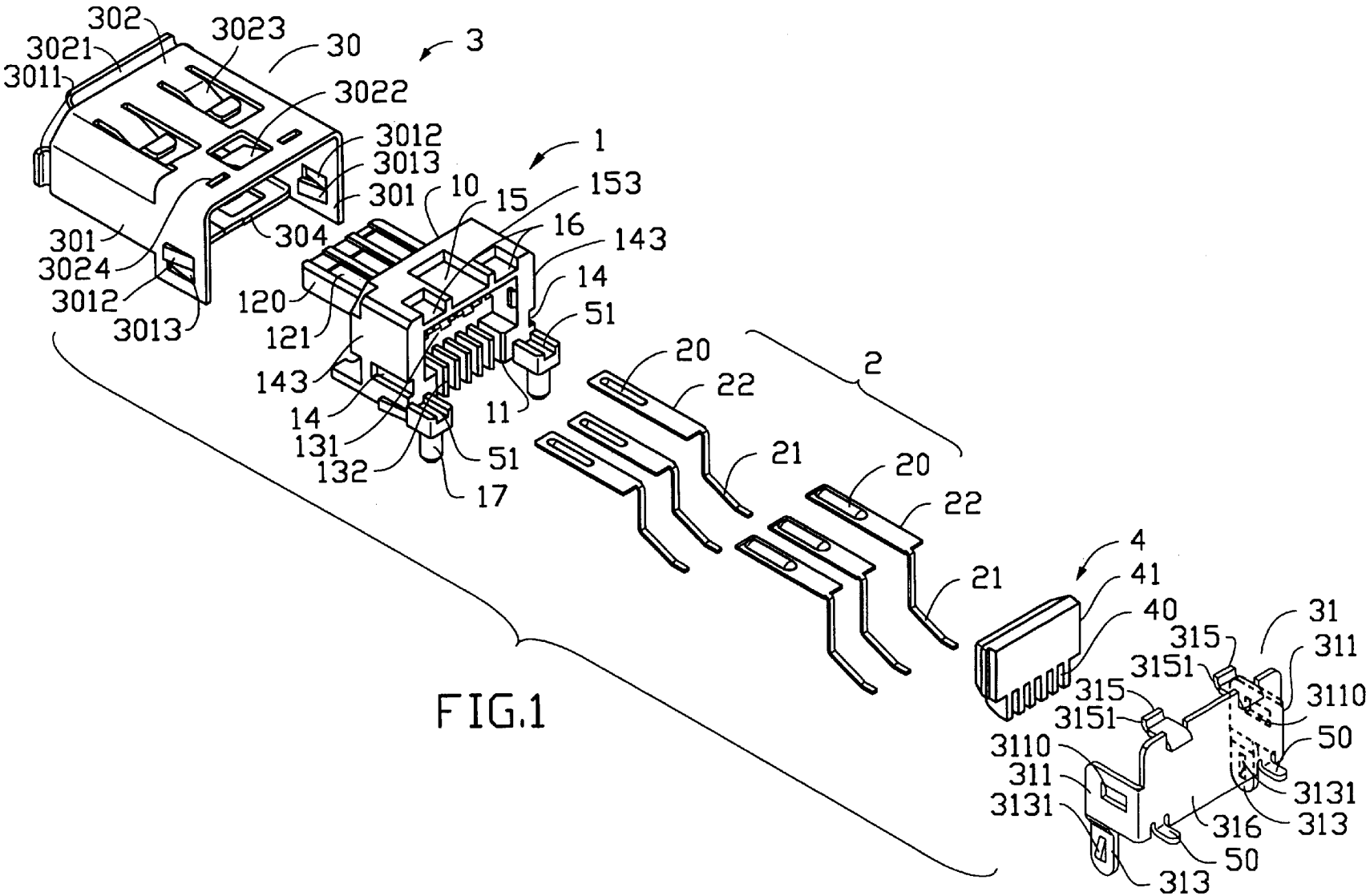
FIG. 1 is an exploded view of an electrical connector in accordance with the present invention.
Figure 2:
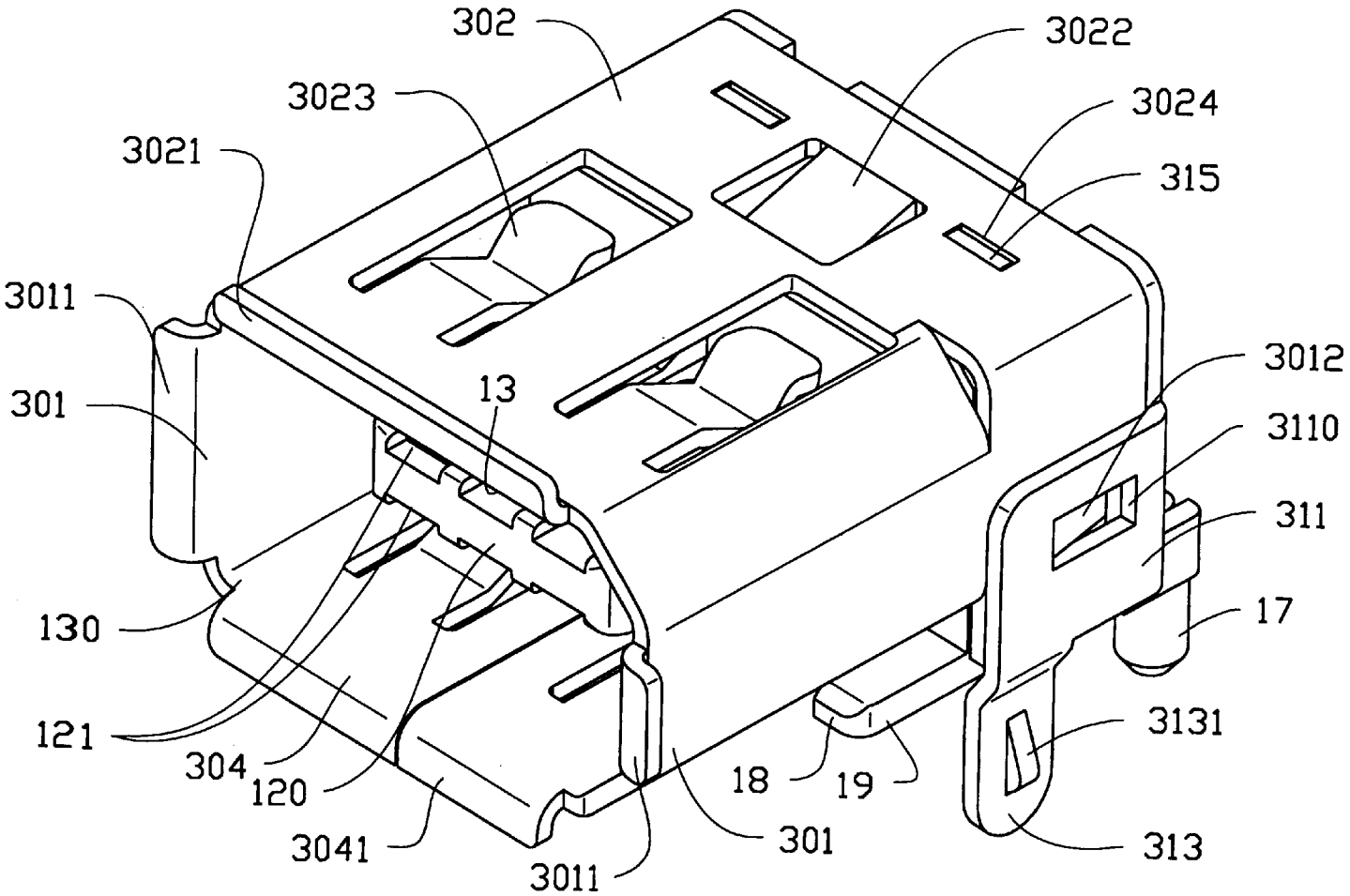
FIG. 2 is an assembled view of FIG. 1.

Referring to FIGS. 1 and 2, an electrical connector in accordance with the present invention comprises an insulative housing 1, contacts 2 and a positioning device 4 received in the insulative housing 1, and a first shielding 30 and a second shielding 31 connected to and covering most of the housing 1, wherein the shieldings 30, 31 are made of metal by stamping and bending.

The housing 1 has a mating face 10 on a front portion thereof and a mounting (soldering) face 11 on a bottom portion thereof perpendicular to the mating face 10. The housing 1 comprises an upper wall 153 between two side walls 143 thus together forming an inverted U-shaped structure, wherein the upper wall 153 defines a first upper recess 15 and two second upper recesses 16 beside the first upper recess 15, and each side wall 143 defines a sidewall recess 14. A rear receptacle 51 is formed on a rear side edge of each side wall 143 and a positioning member 17 extends downward from a bottom of the rear receptacle 51. A substantially L-shaped intermediate plate 120 is integrated with opposite inner faces of the side walls. Three upper and lower passageways 121 are defined in upper and lower surfaces of the intermediate plate 120. The intermediate plate 120 has a vertical portion and a horizontal portion which extends out through the mating face 10 of the housing. Each passageway 121 defines a substantially right angled channel communicating between the mating face 10 and the mounting face 11. Specifically, each passageway 121 is defined by a horizontal channel portion defined in either one of the opposed surfaces of the horizontal portion of the intermediate plate 120, and a vertical channel portion defined by spaces between spacers 132 projecting from the vertical portion of the intermediate plate 120. A mating space 13 (see FIG. 2) is defined between the first shielding 30 and the horizontal portion of the intermediate plate 120 when the housing 10 and the first shielding 30 are engaged together. A rear space 131 defined between the upper wall 153, the side walls 143 and the spacers 132 receives the positioning device 4 which will be explained later.

The contacts 2 received in the passageways 121 comprise a horizontal portion 22 from which a protrusion 20 projects for contacting with other contacts of a complementary connector, and a multi-bent portion 21 extending from the horizontal portion 22 wherein the horizontal portion 22 has a width more than twice of the multi-bent portion 21. Each horizontal portion 22 of the contact 2 is retained in a corresponding passageway 121 by interferentially fitting with the periphery of the passageway 121 and the multi-bent portion 21 thereof is horizontally retained in position by the spacers 132 of the housing 10.

Figure 3:
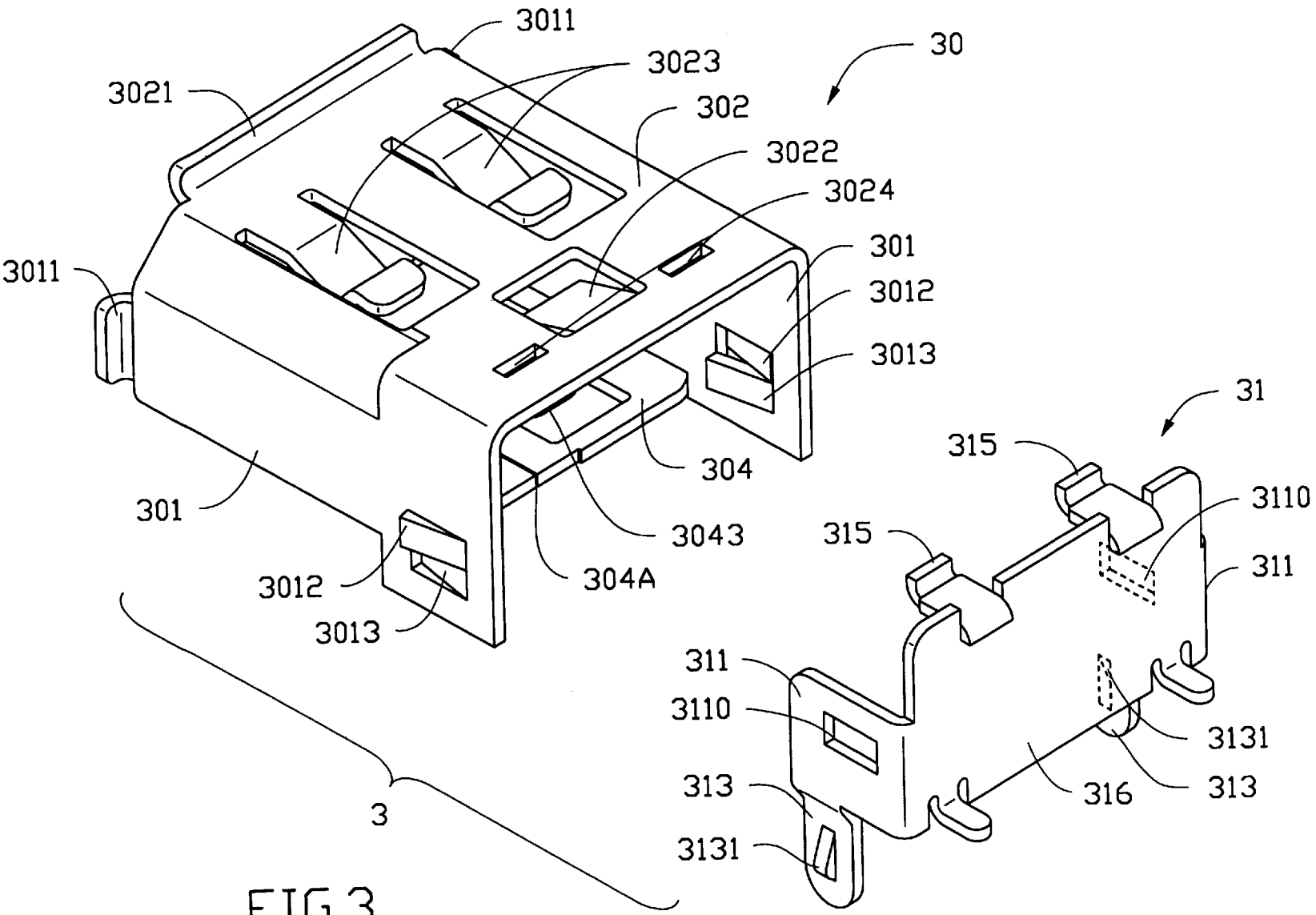
FIG. 3 is an exploded view of a shielding device in accordance with the present invention.
Figure 4:
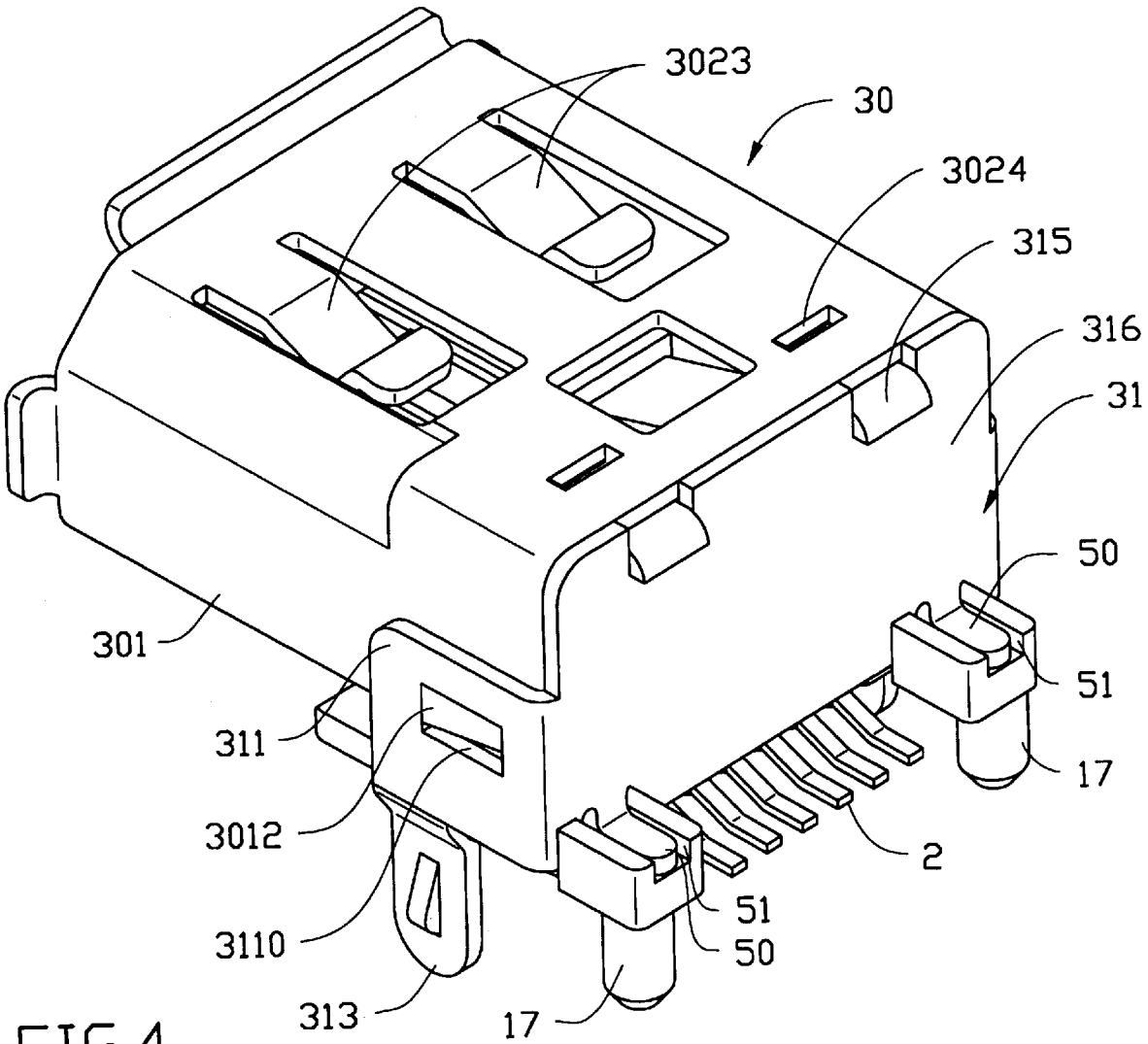
FIG. 4 is an assembled view of FIG. 3.

Also referring to FIG. 3, the first shielding 30 is shaped as a rectangular hollow casing enclosing a virtual axis (not shown) and comprises an upper wall 302 between two side walls 301 which are also connected via a lower wall 304 opposite the upper wall 302. The upper wall 302 forms a guiding flange 3021 curved upward on a front edge thereof, two upper grounding tabs 3023 formed by stamping and bending, an engaging tab 3022 oriented downward for reception in the first upper recess 15 of the housing 10 during assembly, and two slits 3024 defined near a rear edge thereof. The lower wall 304 has a guiding flange 3041 curved downward from a front edge thereof in alignment with the guiding flange 3021 of the upper wall 302 while a rear edge thereof is not in alignment with the rear edge of the upper wall 302 due to the shorter length of the lower wall 304 along the axis. The lower wall 304 has two lower grounding tabs 3043 (only the end portions thereof are shown) confronting the upper grounding tabs 3023 of the upper wall 302 and defining a gap 304A which is the termination of the rectangular casing shape of the first shielding 30 after bending from a raw plate material. The two confronting side walls 301 each have a guiding flange 3011 curved outward with respect to the axis at a front edge thereof. A second shielding engaging tab 3012 and a housing engaging tab 3013 are formed near a rear edge of each side wall 301 for respectively engaging with the second shielding 31 and the sidewall recess 14 of the housing 10. In this embodiment, the second shielding engaging tab 3012 and the housing engaging tab 3013 respectively extend outward and inward with respect to the axis. The guiding flanges 3021, 3041, 3011 of the upper, lower, and side walls 302, 304, 301 diverges outward to facilitate insertion of a complementary connector (not shown). It is also noted that referring to FIG. 2, the housing 1 includes an auxiliary supporting plate 18 defining a space 19 thereabove so that the rear portion of the lower wall 304 can be seated on the supporting plate 18, cooperating with the rear portion of the upper wall 302 abutting against the upper wall 153 of the housing 1, thus stabilizing the first shielding 30 on the housing 1.

The positioning device 4 comprises a body 41 and a plurality of digits 40 extending downward therefrom. The positioning device 4 is sized to be received and retained in the rear space 131 of the housing 10 wherein the digits 40 are interspaced between the spacers 132 of the housing 10 and the multi-bent portions 21 of the contacts 2 are vertically limited in position by the digits 40. Therefore, the positioning device 4 can cooperate with the spacers 132 of the housing 10 to fix the multi-bent portions 21 of the contacts 2 in place and promote soldering efficiency.

The second shielding 31 comprises a rear wall 316 between two side walls 311 substantially perpendicular thereto. The rear wall 316 has two upper engaging tabs 315 each projecting forward and then curvedly bending upward thus forming a curved portion 3151 at the bending point thereof, wherein the curved portion 3151 of each engaging tab 315 is retained in the second upper recess 16 of the housing 10 and the free end thereof is retained in the slit 3024 of the first shielding 30 after assembly as shown in FIG. 2. The rear wall 316 further comprises two rear tabs 50 extending rearward for engaging with the rear receptacles 51 of the housing 10 during assembly. Each side wall 311 defines a hole 3110 for engaging with the second shielding engaging tab 3012 of the first shielding 30 during assembly and comprises a leg 313 extending downward which has a tapered protrusion 3131 projecting therefrom for securing to a hole (not shown) in a mother board.

Since the shieldings 30, 31 are two independent parts they can be treated with different coating materials. For example, the second shielding 31 due to its engagement with the mother board during wave soldering it is apt to be scratched therefore it should be coated with both nickel and tin. Therefore, the two independent parts 30, 31 of the shielding are more durable than a single shielding part during assembly.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. An electrical connector comprising:

an insulative housing having an upper wall between two side walls each defining a sidewall recess therein, an L-shaped intermediate plate integrated with the side walls having a horizontal portion defining passageways therein for interferentially receiving contacts, a vertical portion from which a plurality of spacers extend, and a receiving space defined between the upper wall, the side walls and the spacers;

a first metallic shielding adapted to enclose the housing and having an upper wall opposite a lower wall and two side walls between the upper and lower walls, each side wall having a first engaging tab and a second engaging tab, wherein the second engaging tab engages with the sidewall recess of the housing;

a second metallic shielding having two side walls and a main wall between the side walls wherein each side wall defines a hole for engaging with the first engaging tab of the first shielding;

each contact comprising a horizontal portion interferentially fitting in the corresponding passageway and a multi-bent portion connected to the horizontal portion and horizontally retained in position by the spacers of the housing; and a positioning device including a body portion and a plurality of digits extending downward from the body portion and adapted to be received in the receiving space of the housing, wherein the digits are interspaced between the spacers of the housing for vertically limiting the multi-bent portions of the contacts in position.

2. The electrical connector as claimed in claim 1, wherein the second shielding has at least a bottom leg from which a tapered protrusion extends for securing to a corresponding hole of an external mother board.

3. The electrical connector as claimed in claim 1, wherein the upper wall, the lower wall, and the side walls of the first shielding each form a guiding flange diverging outward with respect to a longitudinal axis through the center of the first shielding.

4. The electrical connector as claimed in claim 1, wherein the first shielding has an engaging tab formed on the upper wall thereof for engaging with a first upper recess defined in the upper wall of the housing.

5. The electrical connector as claimed in claim 1, wherein the first shielding defines at least one slit in the upper wall thereof, the housing defines at least one second upper recess in the upper wall thereof, and the second shielding has at least one upper engaging tab projecting laterally from an upper edge of the rear wall thereof and then curvedly bending upward thus forming a curved portion at the bending point thereof, wherein the curved portion of the at least one engaging tab of the second shielding is retained in the at least one second upper recess of the housing and a free end of the at least one engaging tab of the second shielding is retained in the at least one slit of the first shielding.

6. The electrical connector as claimed in claim 1, wherein the housing has at least one positioning member extending downward from the rear receptacle for location on an external mother board.

7. An electrical connector includes an insulative housing having an L-shaped intermediate plate integrated therein which defines passageways for receiving contacts each of which has a horizontal portion retained in a horizontal portion of the corresponding passageway and a multi-bent portion horizontally limited in a vertical portion of the passageway formed by adjacent spacers, a positioning device received in the housing and having digits extending therefrom for vertically limiting the multi-bent portions of the contacts in position when the digits of the positioning device are interspaced between the spacers, first and second shieldings being configured to enclose the housing to suppress noise and the two shieldings being coated with different materials.

8. The electrical connector as claimed in claim 7, wherein the second shielding is coated with both nickel and tin and the first shielding is coated with tin only.

9. The electrical connector as claimed in claim 7, wherein the upper wall, the lower wall, and the side walls of the first shielding each form a guiding flange diverging outward with respect to a longitudinal axis through the center of the first shielding.

10. The electrical connector as claimed in claim 7, wherein the first shielding has an engaging tab formed on one of the four connected walls for engaging with a first recess defined in the housing.

11. The electrical connector as claimed in claim 9, wherein the first shielding defines at least one slit in the upper wall thereof, the housing defines at least one second upper recess in a corresponding wall thereof, and the second shielding has at least one tab projecting laterally therefrom and then curvedly bending upward thus forming a curved portion at the bending point thereof, wherein the curved portion of the at least one engaging tab of the second shielding is retained in the at least one second recess of the housing and a free end of the at least one engaging tab of the second shielding is retained in the at least one slit of the first shielding.

12. The electrical connector as claimed in claim 7, wherein a rear receptacle extending from the housing engages with a corresponding rear tab extending from the second shielding.

13. The electrical connector as claimed in claim 12, wherein the housing has a positioning member extending downward from the rear receptacle for location on an external mother board.

14. An electrical connector comprising:

an insulative housing;

a plurality of contacts positioned within the housing;

a first shielding cooperating with a second shielding to circumferentially protectively covering the housing, the first shielding covering most portions of the housing and the second shielding covering less portions of the housing with at least one positioning member for location on an external mother board;

wherein said first shielding and said second shielding are coated with different materials.

15. An electrical connector comprising:

an insulative housing with a plurality of contacts therein;

a positioning device positioned adjacent a rear portion of the housing and including means for vertically limiting the contacts in position;

a shielding covering and positioned in the rear of said positioning device wherein said shielding includes two opposite rear tabs extending rearward for engagement with two corresponding receptacles of the housing for stabilization of the shielding with regard to the housing.

16. An electrical connector comprising:

an insulative housing comprising an intermediate plate;

a plurality of passageways defined in said intermediate plate for receiving a corresponding number of contacts therein;

an auxiliary supporting plate integrally horizontally extending, from a bottom portion of the housing, parallel to the intermediate plate, and a shielding including at least an upper wall and a lower wall parallel to each other; wherein the upper wall abuts of the shielding against another upper wall of the housing, and the lower wall abuts against the auxiliary supporting plate of the housing.

* * * * *